United States Patent [19]

DiGilio et al.

[11] 3,933,011

[45] Jan. 20, 1976

[54] RING WITH INTERCHANGEABLE SETTING

[76] Inventors: Philip DiGilio, 843 E. 228th St., Bronx, N.Y. 10466; John Manetta, 7402-19th Ave., Brooklyn, N.Y. 11218

[22] Filed: Mar. 27, 1974

[21] Appl. No.: 455,218

[52] U.S. Cl. ..... 63/29 R; 24/221 R; 403/349

[51] Int. Cl.[2] ..... A44C 17/02

[58] Field of Search ..... 63/29 R; 24/221 R; 403/349; 70/290, 289

[56] References Cited

UNITED STATES PATENTS

| | | | |
|---|---|---|---|
| 464,810 | 12/1891 | Bonner | 63/29 R |
| 501,365 | 7/1893 | Rohde | 63/29 R |
| 615,381 | 12/1898 | Brockett | 70/290 UX |
| 1,102,055 | 6/1914 | Kenney | 24/221 R |
| 1,207,773 | 12/1916 | Larson | 63/29 R |
| 1,857,530 | 5/1932 | Dandridge et al. | 24/221 R |

FOREIGN PATENTS OR APPLICATIONS

| | | | |
|---|---|---|---|
| 245,319 | 11/1946 | Switzerland | 273/156 |
| 1,330,196 | 5/1963 | France | 24/221 R |
| 832,887 | 4/1960 | United Kingdom | 63/29 |

*Primary Examiner*—F. Barry Shay
*Attorney, Agent, or Firm*—Edward F. Costigan

[57] ABSTRACT

An improved ring having an interchangeable setting secured by an improved separable engagement means of the slip and catch variety.

1 Claim, 6 Drawing Figures

RING WITH INTERCHANGEABLE SETTING

This invention broadly relates to improved rings of the ornamental variety having interchangeable settings.

More particularly, this invention relates to the aforesaid type of ring wherein an improved engagement means of the separable variety is provided, the latter being of a programmed nature, for use without special tools or training in the interchangeability of settings thereon by the ordinary wearer of the Art.

In the past, it was thought desirable to provide rings with interchangeable settings for any one of a number of reasons. For instance, in some cases, a wearer would become accustomed to a particular ring because of its inherent feel to one of his or her particular fingers. In such cases, it was found that the latter ornament would be worn more regularly than others. As a result, it was thought, if the setting on this particular ring could be changed, the wearer could be provided with a variety of settings having many styles, shapes and stones to choose from, while still maintaining the desirable feel of the basic ring to such particular person. Also, upon extrapolation of this concept, it was felt that a change of dress relative to style or color might well dictate the use of different ornaments for improvement of the overall look or view of the person, and this could be easily accomplished by merely changing the settings in a base ring.

The concept of the interchangeability of settings on a base ring was quite sound but it was never placed in operation on a large scale basis because it was not freely available to people or ordinary means; the reason being that no satisfactory method of separably engaging the setting to the ring existed. In this regard, it was thought that the use of a ball and socket means would be quite successful. However, upon further analysis, it was found that such engagement means could be accidentally actuated and thus, the lost-factor relative to the setting was quite high. It is evident that the latter factor negated the use of such engagement means, when the setting was of some actual or intrinsic worth. However it could be used where non-precious settings were involved and the value relative to accidental loss of the same were of a negligible nature.

Other means of engagement were thought to be of a more substantive nature, when the setting was of substantial value, but certain disadvantages of each means were repugnant to the free use of such device by the public at large. For instance, for the concept of interchangeability of settings on a common ring base to be of any substantial value, it must in its inherent nature be freely available for use by the ordinary citizen without exorbitant or recurring service cost. In other words, it must be of an operative nature relative to the ordinary citizen without the use of special training or tools or repetitive recourse to the jeweler. The act of changing the setting on the ring must be simple, fast and effectual relative to safety and it must be easily carried out by the ordinary members of the populace.

One type of engagement means which was thought earlier to fulfill the latter described objectives was that of the screw and mating bore variety. It was initially thought that the latter means could only be disengaged by a predetermined act i.e. actually unscrewing the elements one from the other. However, in use, it was found that many times the screw could be actually disengaged from the bore accidentally and without the predetermined disposition or desire of the wearer. To overcome this inherent difficulty with the use of this simple type engagement means, many and varied safety devices were devised and patented to secure the screw in the mating bore. However, it was found that such safety devices were not only complicated and difficult to manufacture but even those of the simplest variety required a jeweler's touch or, in any case, his tools.

For example, of the safety devices discussed above, the simplest was that of the set screw variety. In such a scheme, the set screw would engage the shank of the main engagement screw at an angle of about 90°. But, even if the latter scheme was considered simple, it required the use of not only a magnifying eye-piece but also a special tool of the miniature screw-driver variety. This limited or negated the use of a ring having these attributes by the ordinary person of the general public, especially the ordinary women who generally are not especially oriented in the mechanical aspect of separably engaging such settings to a base ring.

Also, although not considered far-fetched, many people with somewhat impaired vision could not perform the necessary function of separable engagement of the elements, and, in some cases, this is compounded by people whose dispositions are such that they couldn't carry out such tedious functions without proper tools. In any case, the mere changing of a setting could lead to frayed nerves and, in extreme cases, objectionable dispositions after such tasks.

Obviously, it is easier to have a jeweler perform the required function but this leads to increased costs and limits the availability of the devices embodying the aforedescribed concept for the purposes and reasons heretofore set forth. In other words, the ordinary citizen of ordinary means would be reticent to change the setting when it would lead to repetitive recourse to a jeweler and the inherent cost entailed therein. The more freely useful the concept is to the ordinary unskilled person, the more likely the idea would be accepted by the general public for every day implementation or whenever desired.

What is needed in the Art is a ring having interchangeable settings of both the precious or semi-precious variety wherein said setting may be separably engaged in only a predetermined manner, with relatively minor chance of accident, by any ordinary member of the general populace, such as a female, without repetitive and costly recourse to a jeweler, special training or tools, each and every time it is simply desired to change the setting for whatever the reason may be.

The subject invention answers the aforesaid needs of the Art with special emphasis on a ring adapted with means having inherent attributes of improved safety for use by any ordinary citizen of the general public in the predetermined separable engagement of interchangeable settings thereon in a simple, fast, effective and efficient manner without the accompanyment of any substantial factor relative to loss usually inherent in the use of the engagement means of the Art.

It is therefore an object of this invention to provide an improved ring having interchangeable settings possessing the advantageous attributes heretofore set forth.

Another object is to provide the aforesaid ring having a simple, fast, safe, efficient and effective means for separably engaging such setting to the above ring.

A further object is to provide the above ring with improved separable engagement means for use in the interchangeability of the setting to the ring.

Other objects and many of the attendant advantages of this invention will become more apparent to those skilled in the Art from a reading of the following detailed specification when considered with the accompanying drawing, wherein.

Similar numerals refer to similar parts throughout the several views.

Figure 4A:
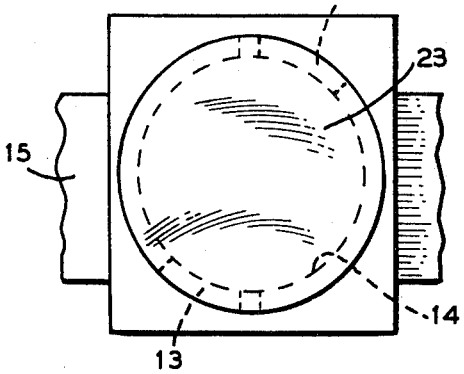
FIG. 4A is a top plan view similar to FIG. 1 but showing the setting engaged to the ring.
Figure 1:
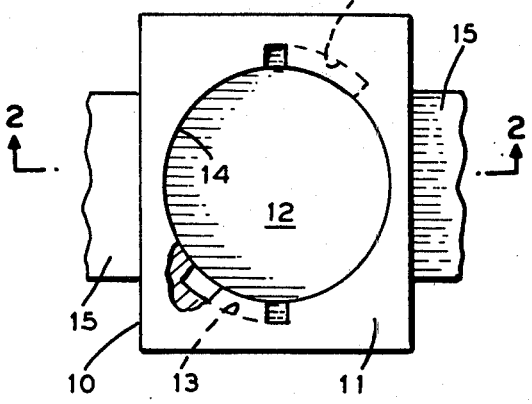
FIG. 1 is a top plan view, in section, showing a ring having a receptive bore for engagement of a mating setting.

Referring to FIG. 1, a ring 10 is shown, in section, having a base 11 provided with a receptive bore 12 adapted with a course of communicating slots 13 set in the inner wall 14 which form the aforesaid bore 12. Note should be taken that the end portions 15 of the annular base 16, which forms the ring, engages each side of the base 11. Although, we show and describe the specific orientation relative to the engagement between the base 11 and the annular ring 16, this is necessary only to show operativeness of the invention and there are many and varied means of engagement between the latter two elements which will also serve this purpose successfully.

Figure 2:
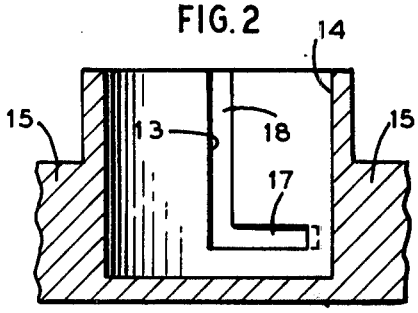
FIG. 2 is a view taken on line 2—2 of FIG. 1.

Further, as shown in FIG. 2, the course of communicating slots 13 in its simplest form consist of a horizonital slot 17 and a vertical slot 18. The described courses are shown disposed in space relation, as shown in FIG. 1, opposite each other in the wall 14 forming the bore 12. The latter course is designed for mating engagement with keys 19 of the setting 21 shown in FIG. 3. The programmed nature of the device is defined as a predetermined communicating course of horizontal and vertical slots for keys to follow.

Figure 3:
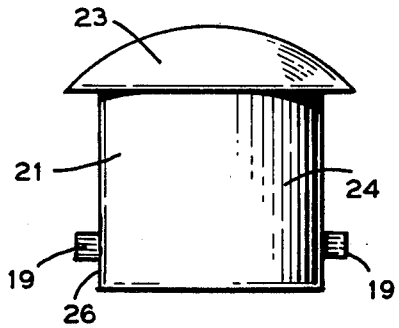
FIG. 3 is a view of the mating setting for the receptive bore of FIG. 1.

The setting 21 is defined as general in nature and the upper surface or ornamentation 23 may take on many sizes, styles, shapes and stones. A basic requirement however is that the engagement portion or keys 19 follow the course set forth in the walls 14 of the bore 12 and that when the keys 19 have fully accomplished their engagement travel, the cylinder 24 is fully nested in a complementary manner relative the surface 14 of the bore 12. In its simplest form, the setting may be described as having an ornamental surface set on or integral with a cylinder 24, whether hollow or not, whose outer surface 26 is provided with a plurality of keys 19 set in a predetermined array or pattern as shown in FIG. 3. Note should be taken that the arrangement or pattern of the keys 19 is dictated by the particular course they are to follow in the surface of the bore 12. The latter course may be adjusted or programmed to provide varying degrees of difficulty relative to the separable engagement of the setting to the ring base. However, this would ultimately depend on the attitude, purpose, or requirement of the purchaser or wearer. However, for practical purposes, there should be at least two courses in spaced and balanced relationship, one to the other.

A simple example of the above proposition may be exhibited by merely increasing the number of courses set out in the surface of the bore. In other words, instead of having at least two courses, there may be three or four courses in spaced relation to each other around the bore for mating engegement with a like number of keys in like-relation or orientation relative to space around the periphery of the cylinder.

Figure 4:
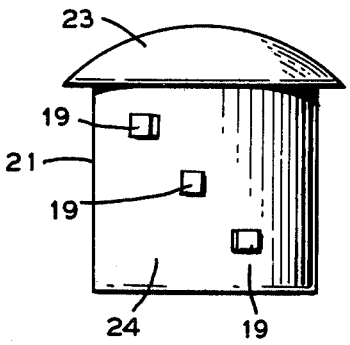
FIG. 4 is a view of another embodiment of the setting of FIG. 3.
Figure 5:
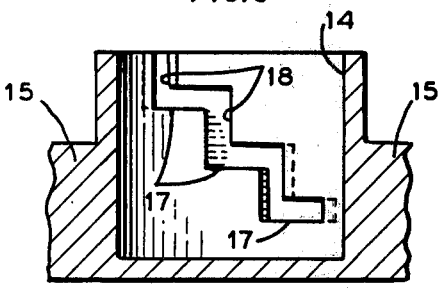
FIG. 5 is a view similar to that of FIG. 2 adapted for the receptive engagement of the setting of FIG. 4.

Another example of a different array of keys 19 may be seen in FIG. 4. This specific array is of a staggered variety wherein the keys are positionally at a different location relative to both the vertical axis and the circumference of the cylinder. In order to accommodate the cylinder of this type setting, the wall of the bore must be programmed for the receptive engagement of the keys on such cylinder. As may be evident from FIG. 5, the lower key relative the vertical axis of the cylinder will enter the course first and when it eventually traverses the initial horizontal slot, it and the second key will be in position for downward vertical travel along the first and second vertical slots, respectively. At this point, after the described travel, the cylinder may be freely turned and the first and second keys will traverse the upper and intermediate horizontal slots and the three keys will be in position to enter the vertical course of slots. A mere "downward slip and turning catch" will then secure the setting in position relative to the bore.

The arrays heretofore described are basic and others will become evident to those skilled in the Art from reading the aforesaid description of the invention.

In the alternative, for ease of manufacture, the course desired may be set into a metal band and the latter may be insertably engaged to the bore of a base ring by threads or otherwise. In this manner, a number of base rings may be produced and later set relative to course according to the desires of the purchaser. After this initial setting of the band, no need would exist to have recourse to a jeweler merely to change a setting and the initial interchangeable concept would finally become fully and freely available and operative by each and every wearer without special tools or training.

Further, simple casting and metal working techniques well known in the jewelry art may be utilized to produce the basic ring itself and its interchangeable settings. Also, the final product may not only be directed for ornamentation by costume jewelry but, as a result of the inherent safety factor, the product may also be directed for use with precious settings.

We claim:

1. In an improved ring having an interchangeable setting, the improvement wherein:

said ring is provided with a base having a cylindrical bore, said setting having a cylindrical body adapted for mating engagement with said bore, said bore having a surface provided with at least two programmed courses, the latter in spaced, balanced relationship, one to the other, around the surface of said bore, each of said programmed courses including an array of steps, each of said steps consisting of a horizontal slot followed in series by a communicating vertical slot on the surface of said bore, said body having at least two separate arrays of protruding keys on said cylindrical surface, said key arrays being adapted to simultaneously traverse respective ones of said courses in the separation or engagement of said body relative to said base.

* * * * *